United States Patent [19]

Heki et al.

[11] Patent Number: 4,816,290

[45] Date of Patent: Mar. 28, 1989

[54] PROCESS OF FORMING SOLID GRANULAR FILM

[75] Inventors: Tatsuo Heki; Noriyuki Inoue, both of Ashigara, Japan

[73] Assignee: Fuji Photo Film Co., Ltd., Kanagawa, Japan

[21] Appl. No.: 36,450

[22] Filed: Apr. 9, 1987

[30] Foreign Application Priority Data

Apr. 10, 1986 [JP] Japan ..... 61-81136

[51] Int. Cl.[4] ..... B05D 1/18; G03C 1/02

[52] U.S. Cl. ..... 427/430.1; 427/435; 427/439; 427/443.2; 430/567; 430/568; 430/569; 430/631; 430/635; 430/641; 430/642

[58] Field of Search ..... 430/567, 568, 569, 631, 430/635, 642, 641; 427/430.1, 435, 439, 443.2

[56] References Cited

U.S. PATENT DOCUMENTS

| | | | |
|---|---|---|---|
| 2,801,171 | 7/1957 | Fierke et al. | 430/546 |
| 3,622,318 | 11/1971 | Evans | 430/567 X |
| 4,334,012 | 6/1982 | Mighot | 430/567 |
| 4,378,425 | 3/1983 | Schnoring et al. | 430/569 X |
| 4,474,872 | 10/1984 | Onishi et al. | 430/569 X |

*Primary Examiner*—Thurman K. Page

*Attorney, Agent, or Firm*—Burns, Doane, Swecker & Mathis

[57] ABSTRACT

A process of forming a solid granular film is disclosed, which comprises dispersing solid granules into a liquid with the aid of a dispersant, removing the dispersant from the resulting dispersion to suspend the solid granules at the vapor-liquid interface, and transferring the solid granules onto a support, whereby high covering power is attained with respect to solid granules.

14 Claims, 1 Drawing Sheet

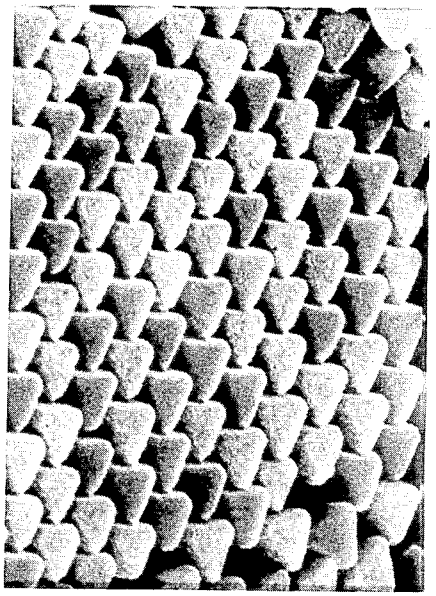

PROCESS OF FORMING SOLID GRANULAR FILM

FIELD OF THE INVENTION

The present invention relates to a process of forming a solid granular film which is particularly useful in fields where it is expected to attain higher covering power with smaller amounts of solid granules such as in the coating and the photographic industries.

BACKGROUND OF THE INVENTION

The Langmuir-Blodgett method is one process wherein a film has been formed by transferring a monomolecular film spread out over the vapor-liquid interface onto the surface of a support. In this method, each individual molecule has surface activity, i.e., both a hydrophilic group and a hydrophobic group, and is transferred with other molecules having surface activity onto a support in the form of monomolecular film, as described in *J. Am. Chem. Sco.,* Vol. 57, p. 107 (1935). Also, various improvements on this method have been proposed, as described in *Thin Film Processes,* Academic Press (1978); *Langmuir-Blodgett Films,* Elsevier (1980); *Thin Solid Films,* 68 (1), 1, 101, 135 (1980) and ibid., 99 (1-3) (1983); *J. Am. Chem. Soc.,* Vol. 60, p. 1351 (1938); *J. Colloid Interface Sci.,* Vol. 54, p. 430 (1976); and *Thin Solid Films,* Vol. 99, p. 235 (1982), ibid., Vol. 100, p. 67 (1983), and ibid., Vol. 105, p. 674 (1983).

The above methods generally involve dissolving a surface active substance in a volatile solvent such as benzene or chloroform, dropping the solution onto the surface of water and evaporating the solvent to form at the vapor-liquid interface a monomolecular layer maintaining an adequate balance between the hydrophilic group and the hydrophobic group of each individual molecule of the surface active substance. The monomolecular layer is a homogeneous solid film composed of the molecules of the surface active substance and having no interface between the molecules.

However, since these methods utilize the surface activity of each individual molecule, they are only applicable to substances having the so-called surface activity to be dissolved or dispersed in the form of molecule in a medium. That is, these methods cannot be applied to solid granules, particular those which are substantially insoluble in the medium, such as inorganic or organic pigments to be used in the coating industry and silver halides to be used in the photographic industry, to arrange them regularly in the form of film.

If these pigments could be arranged regularly in the form of film and transferred onto the support, their covering powers would be generally increased, therefore, a reduction of the coverage of pigment or silver would be achieved. In addition, properties of the coated surface such as image qualities in the photographic industry can be improved if the solid granules are arranged in such a filmy condition over the support.

*Physical Review Letters,* Vol. 55, p. 226 (July 1985) and ibid., Vol. 45, p. 569 (August 1980) disclose two-dimensionally regular arrangement formed by using monodisperse spherical solid latex particles and adhering the particles at an interface. However, this method provides the regular arrangement only with a limited number of the particles and thus having only a small area. Further, these references do not disclose transfer of the arranged latex particles onto the surface of a support, and the arranged latex particles cannot be transferred onto the support without losing the regularity in arrangement.

So far as silver halide photographic materials use in the photographic industry are concerned, various methods of increasing the covering power to reduce the cost have been attempted. For example, increased covering power can be generally attained by decreasing the grain size of the silver halide grains. Furthermore, the decrease in grain size can bring about improvements in granularity and sharpness. However, reducing the grain size causes a reduction in sensitivity. Therefore, it is difficult to obtain photographic materials in which the above-described factors are well balanced. As for the covering power, it can also be increased by using tabular silver halide grains. However, tabular silver halide grains are usually unstable. This is described in, e.g., Japanese Patent Application (OPI) No. 113926/83 (the term "OPI" as used herein means an "unexamined published application").

The above problems can be solved for the most part by arranging silver halide grains regularly in a filmy condition, in a photographic emulsion layer of the sensitive material. Therefore, the attainment of a nonrandom condition is the subject of many investigations in the photographic art.

SUMMARY OF THE INVENTION

Therefore, an object of the present invention is to transfer solid granules in a film, particularly those granules which are substantially insoluble in a solvent, onto a support surface while increasing the covering power and improving the properties of the formed film.

The above-described object is achieved by the process of the present invention of forming a solid granular film wherein solid granules are dispersed into a liquid with the aid of a dispersant, the dispersant is removed from the resulting dispersion, whereby surface tension of the dispersion increases to suspend the solid granules at the vapor-liquid interface, and the solid granules are transferred onto the support.

BRIEF DESCRIPTION OF THE DRAWING

The figure is a micrograph showing the surface of a solid granular film obtained in Example 2 in accordance with the present invention.

DETAILED DESCRIPTION OF THE INVENTION

Examples of solid granules which can be used in the present invention include silver halides; inorganic pigments such as carbon black, titanium dioxide, red iron oxide ultramarine blue, prussian blue, zinc white, white lead, red lead and chrome yellow; and organic pigments such as Toluidine Red, Phthalocyanine Blue and Phthalocyanine Green, as described in, for example, *Bunsan Gijutsu Sogo Shiryo-Shu* (which means a collection of composite data on dispersion techniques) published by the press section of Keiei Kaihatsu Center.

A mean grain size of the solid granules preferably ranges from 0.05 micron to 2 microns and more preferably from 0.1 micron to 1.5 microns. The grain size used herein refers to a grain diameter in case of spherical or approximately spherical granules and refers to the edge length in case of cubic granules. In both cases, the mean is based on projected areas of the granules. The distribution of the grain size may be either narrow or broad but preferably narrow. In particular, the so-called monodisperse granules wherein at least 90% of the total solid granules are in the grain size range of ±30% of the mean grain size are preferred. Two or more kinds of solid granules differing in mean grain size may be used in combination. In this case, the distribution of the grain size of each kind of solid granules is preferably narrow.

Examples of dispersants which can be used in the present invention include anionic, cationic, betaine and nonionic dispersants. In addition, high polymer and oligomer dispersants may be used. Also, hydrophilic colloids such as those which are used for the dispersion of silver halide grains in making a photographic emulsion are included among the dispersants. Of the above, polymeric surface active agents and hydrophilic colloids, which can exhibit high dispersion stability, are particularly preferred.

Suitable examples of surface active agents include nonionic surface active agents such as saponin (of steroid type), alkylene oxide derivatives such as polyethylene glycol, polyethylene glycol/polypropylene glycol condensates, polyethylene glycol alkyl ethers, polyethylene glycol alkyl aryl ethers, polyethylene glycol esters, polyethylene glycol sorbitane esters, polyalkylene glycol alkylamines or amides and polyethylene oxide adducts of silicone, glycidol derivatives such as alkenylsuccinic polyglycerides and alkylphenol polyglycerides, fatty acid esters of polyhydric alcohols, alkyl esters of sugar,and nonionic surface active agents as those described in *J. Am. Oil. Chem. Sec.*, Vol. 54, p. 110 (1977); e.g., Pluronic (registered trade mark):

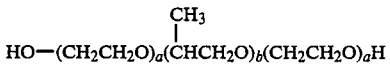

Pluronic (registered trade mark):

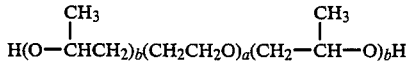

Tetronic (registered trade mark):

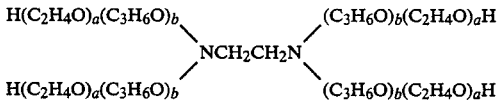

Pluradot (registered trade mark):

$$R[O(C_3H_6O/C_2H_4O)_n-(C_2H_4O/C_3H_6O)_mH]_3;$$

anion surface active agents containing an acid group like a carboxyl, sulfo, phospho, sulfate or phosphate group such as alkylcarboxylates, alkylsulfonates, alkylbenzenesulfonates, alkylnaphthalenesulfonates, alkylsulfates, alkylphosphates, N-acyl-N-alkyltaurine, sulfosuccinic acid esters, sulfoalkylpolyoxyethylene alkyl phenyl ethers, and polyoxyethylene alkylphosphates; amphoteric surface active agents such as amino acids, aminoalkylsulfonic acids, aminoalkyl sulfates or phosphates, alkylbetaines, and amine oxides; and cationic surface active agents such as alkylamine salts, aliphatic or aromatic quaternary ammonium salts, heterocyclic quaternary ammonium salts like pyridinium and imidazolium, aliphatic phosphonium or sulfonium salts and hetero ring-contained phosphonium or sulfonium salts.

Specific examples of these surface active agents are described in U.S. Pat. Nos. 2,240,472, 2,831,766, 3,158,484, 3,068,214, 3,294,540, 3,507,660, 2,739,891, 2,823,123, 3,125,555, .3,060,156, 3,415,649, 3,666,478, 3,756,828, 3,133,816, 3,441,413, 2,868,755, 2,868,814, 2,874,151, 3,545,974, 3,726,683, 2,828,276, 3,843,368, 2,271,623, 2,828,277, 2,828,280, 2,944,900, 3,253,919, 2,828,281, 2,828,823, 2,849,411, 3,589,906 and 4,198,478, British patent Nos. 1,012,495, 722,258, 1,022,878, 1,179,290, 1,198,450, 1,397,218, 1,138,514, 1,159,825, 1,098,931, 1,059,117, 898,759, 960,029, 1,507,961 and 1,503,218, Belgian Patent Nos. 731,126 and 624,261, Dutch Patent Application No. 6,614,711 (Dow Chemical Co., filed Apr. 20, 1967), German Patent Application (OLS) Nos. 1,961,638 and 1,229,729, Japanese Patent Publication Nos. 20740/63, 13750/68, 21811/72, 34832/72 and 34833/72, Japanese Patent Application (OPI) Nos. 117414/75, 59025/75, 139532/78, 21922/78, 113031/80, 108113/82, 63124/82, 124430/76, 134627/76, 54108/77 and 72381/77, *J. Colloid and Interface Sci.*, Vol. 37, p. 93 (1971), Kitahara et al., *Kaimen Kasseizai-Bussei Ohoyo Kagaku Seitaigaku* (which means "Surface Active Agents-Their Properties, Application and Chemical Ecology"), p. 126, Kodan-sha; Takao Kariyone, *Kaimen Kasseizai no Seishitsu to Ohoyo* (which means "Properties and Application of Surface Active Agents"), p. 167, Sachi Shobo; Ichiro Nishi et al., *Kaimen Kasseizai Binran* (which means "Handbook of Surface Active Agents"), p. 565, Sangyo Tosho; *Kogyo Kagaku Zasshi* (which means "Journal of Industrial Chemistry"), Vol. 66, p. 391 (1963) and *Bull. Chem. Soc. Japan*, Vol. 41, p. 564 (1968).

Of these surface active agents, those assuming an oligomeric or polymeric form are preferred. Suitable examples of polymeric surface active agents include those described in Japanese Patent Application (OPI) No. 113031/80, which are represented by the following general formula:

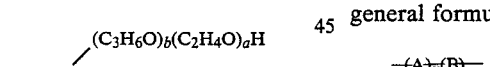

wherein A represents an ethylenic unsaturated monomer containing a sulfonic acid group, B represents an ethylenic unsaturated monomer capable of undergoing copolymerization, x represents 10 to 100 mole%, and y represents 0 to 90 mole%.

As for the oligomers, Demoru E and Demoru N, produced by Kao Atlas Co., Ltd., and made up of the repeating units illustrated below, are useful:

Demoru E

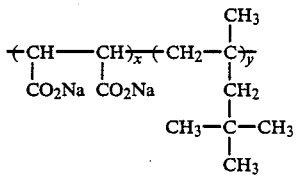

Demoru N

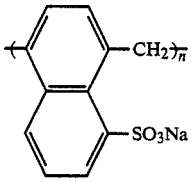

Examples of other oligomers useful in the present invention include those described in Japanese Patent Application (OPI) No. 108113/82, having the following repeating units:

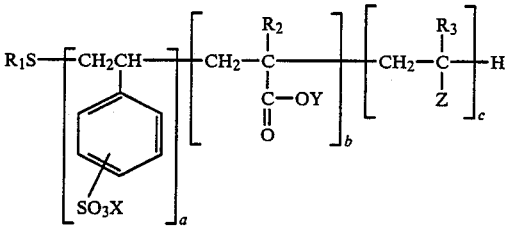

wherein a/(a+b+c) is 0.01 to 0.6, b/(a+b+c) is 0.01 to 0.8, c/(a+b+c) is 0 to 0.9, a+b+c is 2 to 70, $R_1$ represents an alkyl group containing 6 to 16 carbon atoms, $R_2$ represents a hydrogen atom, a methyl group, a carboxyl group, a carboxylmethyl group, or an alkali salt thereof, $R_3$ represents a hydrogen atom, or an alkyl group containing 1 to 4 carbon atoms, X represents ammonium ($NH_4$), another quaternary amino group, an alkali metal, or an alkaline earth metal, and Z represents an amido group or a derivative thereof, a phenyl group or a derivative thereof, an alkyl carboxylate group, or a nitrile group. In addition, those oligomers described in Japanese Patent Application (OPI) No. 63124/82 and having the following repeating units have been found to be useful in the present invention:

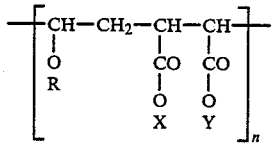

wherein R represents a branched chain or unsaturated alkyl group containing 1 to 20 carbon atoms, X and Y each represents a hydrogen atom, an alkali metal, an ammonium or another quaternary amino group, or an alkyl group, and n represents a mean number of repeating units which is normally 3 to 10 when at least either component in the repeating unit, an alkyl vinyl ether or a maleic acid derivative, is a bulky monomer, while it is 11 or more when neither component is a bulky monomer.

As for the hydrophilic colloids which can be used in the present invention, gelatins are of great advantage. However, other hydrophilic colloids may also be used.

For example, proteins such as gelatin derivatives, graft copolymers of gelatin and other high polymers, albumin and casein, sugar derivatives including cellulose derivatives such as hydroxyethyl cellulose, carboxymethyl cellulose, cellulose sulfate and the like, sodium alginate and starch derivatives, and various kinds of synthetic hydrophilic macromolecular substances including homopolymers and copolymers, such as polyvinyl alcohol, partial acetal of polyvinyl alcohol, poly-N-vinylpyrrolidone, polyacrylic acid, polymethacrylic acid, polyacrylamide, polyvinyl pyrrolidone, polyvinyl imidazole and polyvinyl pyrazole may be used.

Examples of gelatins which may be used include not only lime-processed gelatin, but also acid-processed gelatin, and enzyme-processed gelatin as described in *Bull. Soc. Sci. Phot. Japan,* No. 16, p. 30 (1966). In addition, hydrolysis products of gelatin and enzymatic degradation products of gelatin can be employed.

Examples of gelatin derivatives which may be used include those obtained by reaction of gelatin with various compounds such as acid halides, acid anhydrides, isocyanates, bromoacetic acid, alkanesultones, vinylsulfonamides, maleinimide compounds, polyalkylene oxides and epoxy compounds.

Of the above dispersants, polymeric surface active agents, polyvinyl alcohol, gelatin and carboxymethyl cellulose are particularly preferred.

As for the solvents which may be used for the dispersion of the present invention, water is of particularly advantageous. However, organic solvents such as methanol, acetone and the like may be used individually, as a mixture of two or more thereof, or as a mixture with water.

Examples of supports to be employed in the present invention include all materials which are generally used for this purpose. That is, glass, ceramics, silicon, metals, plastics, mica, carbon, and the like can be used. More specifically, supports which are typically used for photographic materials such as polyethylene terephthalate and cellulose triacetate are particularly advantageous.

In addition, the supports may include multiple layers if necessary. Furthermore, supports can assume a desired form such as, e.g., the form of a plate, a cylinder, a sphere, a square pillar or a sheet.

The solid granules are dispersed in the solvent with the aid of the above-described dispersant generally at a temperature of from 0° to 90° C., preferably from 30° to 80° C. and at a pressure of from 0.5 to 10 atms, preferably at an atmospheric pressure. The content of the solid granules in the dispersion is generally from 0.5 to 20 wt % and preferably from 2 to 8 wt %, and the content of the dispersant is generally from 0.001 to 10 wt % and preferably from 0.01 to 1 wt %.

Removal of the dispersant from the dispersion can be carried out in a conventional method generally under the conditions of up to 60° C. and an atmospheric pressure. One method involves sedimenting solid granules from the dispersion spontaneously or using a centrifuge, removing a portion of the dispersant as a supernatant by decantation, discharging with suction, and, if necessary, washing several times by supplying water to the sediment and removing the supernatant. Another method involves the ultrafiltration of a dispersant. In this method, the dispersant is removed from the dispersion through an ultrafiltration film as water is supplied to the dispersion. Examples of the ultrafiltration method as applied to photographic emulsions can be found in Japanese Patent Publication No. 10957/75, Japanese patent application (OPI) No. 209823/82, and U.S. Pat Nos. 4,334,012 and 3,782,953. An amount of the dispersant to be removed does not have any particular limitation and it is selected according to the type of solid granules, the type of solvent and the type of dispersant. In general, however, the amount of the dispersant is reduced to from 1/10 to $1/10^8$, preferably from $1/10^2$ to $1/10^6$, that of the dispersant initially added in the dispersion, and it is generally from $10^{-8}$ to 1 g, preferably from $10^{-6}$ to $10^{-3}$ g, per liter of the dispersion. The surface tension of the dispersion after removal of the dispersant is preferably from 65 to 80 dyn/cm$^2$ and particularly preferably from 69 to 75 dyn/cm$^2$.

After removal of the dispersant from the dispersion, the resulting dispersion is allowed to stand for 1 minute or more, preferably 3 minutes to 12 hours. Thereupon, the solid granules are suspended in a manner wherein they are arranged almost regularly as a monogranular layer having interface between the solid granules. That is, the granules are suspended in a filmy condition at the vapor-liquid interface.

The solid granules suspended in a filmy condition can then be transferred easily from the interface to a support, and if necessary, in a form of accumulated layers, using a suitable method such as the Langmuir-Blodgett method.

More specifically, a solid granule-containing dispersion from which a dispersant has been removed is transferred into a prescribed trough and allowed to stand for 5 minutes or more to suspend the solid granules at the vapor-liquid interface. The suspended solid granules are than passed onto a support by gently lifting the support at the brim of the trough.

Alternatively, a dispersion which has received the same treatment as described above may be transferred into a trough having an outlet in the bottom or lower part thereof, and allowed to stand to suspend the solid granules at the vapor-liquid interface. Thereafter, a portion of the dispersion is slowly removed through the outlet together with the sedimented solid granules and then, a support is slowly introduced into the dispersion from the brim of the trough, followed by gradually removing the remaining dispersion medium until the suspended granules are transferred onto the support.

After transferring the suspended solid granules to the support, the residual dispersion may be stirred and allowed to stand until the granules which have been precipitated come to be suspended in a filmy condition. Thereafter, a solid granular film may be repeatedly transferred to the support, if desired.

The solid granular film-forming method of the present invention is particularly advantageous when used to produce silver halide photographic materials. The application of the method of the present invention to photographic materials is described in detail below.

In accordance with the present invention, a hydrophilic colloid is removed from a silver halide emulsion prepared by dispersing silver halide grains into a solvent using the hydrophilic colloid thereby suspending the silver halide grains at the vapor-liquid interface, and then the grains are transferred onto a support. Thus, a photographic material having an emulsion layer in which the silver halide grains are arranged in a dense and regular manner is obtained.

Usually silver halide emulsions to be employed in the present invention are prepared by mixing a solution of a water-soluble silver salt such as silver nitrate with a solution of a water-soluble halide such as potassium bromide in the presence of a solution of a water-soluble high polymer such as gelatin. Silver halide includes not only silver chloride and silver bromide, but also mixed silver halides, such as silver chlorobromide, silver iodobromide and silver chloroiodobromide.

These silver halide grains may have any crystal form, such as that of a cube, octahedron or a composite form. Of these forms, the cube, octahedron, dodecahedron and tetradecahedron forms are preferred.

Two or more kinds of silver halide photographic emulsions which are prepared separately may be used as a mixture. The silver halide grains may be uniform throughout in crystal form, or the interior and the surface of the silver halide grains may differ in quality and form a layer structure. Furthermore, the silver halide grains may be those of the conversion type described in British patent No. 635,841 and U.S. Pat. No. 3,622,318. Also, these silver halide emulsions may be either those which form a latent image predominantly at the surface of the grains, or those which form a latent image inside the grains.

These photographic emulsions can be prepared using various methods. Suitable methods are described in C. E. K. Mees, *The Theory of the Photographic Process,* 4th ed., Macmillan, New York (1976); P. Glafkides, *Chimie et Photographique,* Paul Montel, Paris (1957); G. F. Duffin, *Photographic Emulsion Chemistry,* The Focal Press, London (1966); and V. L. Zelikman, et al, *Making and Coating Photographic Emulsion,* The Focal Press, London (1964). More specifically, the processes referred to as the acid process, the neutral process and the ammoniacal process may be employed.

Suitable methods for reacting a water-soluble silver salt with a water-soluble halide include the single jet method, the double jet method or combinations thereof.

Also, the reverse mixing method wherein the silver halide grains are produced in the presence of excess silver ion may be employed. Moreover, the controlled double jet method wherein the pAg of the liquid phase in which silver halide grains are precipitated is maintained constant, may be employed. According to this method, silver halide emulsions having a regular crystal form and almost uniform grain size, may be obtained.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present. Furthermore, it is desirable that thioether compounds such as those described in U.S. Pat. No. 3,574,628 be present in the foregoing process.

The silver halide emulsions may be primitive emulsions and are usually chemically sensitized. Chemical sensitization can be effected using those methods described in P. Glafkides, supra; V. L. Zelikman et al, supra and H. Frieser, *Die Grundlagen der Photographischen Prozesse mit Silberhalogeniden,* Akademische Verlagsgesellschaft (1968).

Specifically, suitable sensitization methods include sulfur sensitization methods which utilizes active gelatin or a sulfur containing compound capable of reacting with sivler ion such as thiosulfates, thioureas, mercapto compounds and rhodamines, reduction sensitization methods which utilize a reducing substance such as stannous salts, amines, hydrazine derivatives, formamidinesulfinic acid and silane compounds, noble metal sensitization methods which utilizes a metal compound such as gold compounds and complex salts of Group VIII metals such as Pt, Ir, Pd. These methods may be employed individually or as a combination thereof.

The silver halide emulsion may be subjected to chemical sensitization before or after receiving treatment for reducing the amount hydrophilic colloid therein. Preferably, the chemical sensitization is conducted in an emulsion whose hydrophilic colloid content has been reduced.

Since photographic emulsions which can be used in the present invention contain hydrophilic colloids in reduced amounts, it may be particularly beneficial to incorporate a wide variety of compounds into the photographic emulsions for preventing fog or stabilizing photographic functions during production, storage or photographic processing. Specific examples of such compounds include azoles such as benzothiazolium salts, nitroimidazoles, nitrobenzimidazoles, chlorobenzimidazoles, bromobenzimidazoles, nitroindazoles, benzotriazoles and aminotriazoles, mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines and mercaptotriazines, thioketo compounds like oxazolinethione, azaindenes such as triazaindenes and tetraazaindenes (especially 4-hydroxy-substituted (1,3,3a,7)-tetraazaindenes), and antifoggants or stabilizing compounds such as benzenethiosulfonic acid, benzenesulfinic acid and benzenesulfonic acid amide and so on.

In particular, mercapto compounds such as those described in U.S. Patents 3,295,976, 3,397,987 and 3,266,897, and tetrazaindenes such as those described in U.S. Pat. Nos. 3,411,914, 2,933,388 and 3,202,512, especially 1-phenyl-5-mercaptotetrazole and 4-hydroxy-6-methyl-1,3,3a,7-tetrazaindene, have been found to produce good results.

Specific examples of compounds which may be employed in the present invention are described in more detail in U.S. Pat. Nos. 3,954,474 and 3,982,947, and Japanese patent publication No. 28660/77.

Antifoggants may be present in the emulsion layer of the present invention and/or other layers. They may be added to the emulsion at any stage during the process of making the emulsion.

The photographic emulsions to be employed in the present invention may be spectrally sensitized with methine dyes, or other dyes. Suitable dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. Any nuclei present in cyanine dyes can be basic heterocyclic nuclei of these dyes. More specifically, basic heterocyclic nuclei may include pyrroline, oxazoline, thiazoline, pyrrole, oxazole, thiazole, selenazole, imidazole, tetrazole and pyridine nuclei. Other basic heterocyclic nuclei include those nuclei formed by fusing together one of the above-described nuclei and an alicyclic hydrocarbon ring and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole and quinoline. Each of these nuclei may also be substituted on a carbon atom.

The merocyanine and complex merocyanine dyes may contain 5- or 6-membered heterocyclic nuclei such as pyrozoline-5-one, thiohydantoin, 2-thioxazolidine-2,4-dione, thiazolidine-2,4-dione, rhodanine and thiobarbituric acid as the nuclei having a ketomethylene structure.

In order to increase the photographic speed and contrast, or in order to accelerate the developing rate, the photographic emulsion layers constituting the photographic light-sensitive material may contain polyalkylene oxides and derivatives thereof, such as the ethers, the esters and the amines thereof, thioether compounds, thiomorpholines, quaternary ammonium salt compounds, urethane derivatives, urea derivatives, imidazole derivatives and 3-pyrazolidones. More specifically, those compounds described in U.S. Pat. Nos. 2,400,532, 2,423,549, 2,716,062, 3,617,280, 3,772,021 and 3,808,003, and British Patent 1,488,991 may be employed.

Photographic emulsion layers and other hydrophilic colloid layers of the photographic material produced in accordance with the present invention may contain dispersions of water insoluble or slightly soluble synthetic polymers for the purpose of improving dimensional stability. Suitable examples of such polymers include those containing as constituent monomers an alkyl(meth)acrylate, an alkoxyalkyl(meth)acrylate, an glycidyl(meth)acrylate, a (meth)acrylamide, a vinyl ester (e.g., vinyl acetate), acrylonitrile, an olefin or a styrene individually or in combination of two or more thereof, or in combination with acrylic acid, methacrylic acid, an $\alpha,\beta$-unsaturated dicarboxylic acid, a hydroxyalkyl(meth)acrylate, a sulfoalkyl(meth)acrylate or a styrenesulfonic acid.

In transferring the silver halide emulsion onto a support after removing the hydrophilic colloid, a preferred concentration of the hydrophilic colloid in the emulsion is 1 wt % or less. Preferably the concentration is 0.1 wt % or less.

The emulsion layer formed in accordance with the present invention contains silver halide grains in a regular arrangement since the silver halide grains contained in the filmy form at the vapor-liquid interface are transferred as they are onto the support. Accordingly, the silver halide grains are present in a dense and effective manner in the emulsion layer and thereby increasing the covering power and reducing the necessary amount of silver.

In general, as the grain size is reduced the covering power increases and the sensitivity decreases. However, the covering power can be increased by arranging regularly, silver halide grains in accordance with the present invention thereby retaining a definite optical density with large-sized silver halide grains while avoiding a loss of sensitivity.

The so-called graininess results from the visual perception of the gathered state of silver grains. In general, the arrangement of individual silver halide grains is irregular in the emulsion layer because the silver grains overlap from the surface of the emulsion layer to the base thereof. Consequently, the silver grains present the appearance of clusters. In contrast, regularly arranged silver grains ensure improved graininess, even if the individual grains are large in size. Therefore, high sensitivity may be obtained. Also, sharpness can be improved in accordance with the present invention because the thickness of the emulsion layer may be decreased without lowering the maximum density by raising the silver halide concentration in the emulsion layer relative to the concentration of hydrophilic colloid and arranging the silver halide grains with regularity in the emulsion layer.

In addition, a protective layer may be provided on the emulsion layer formed in accordance with the present invention. The protective layer may be formed by coating a solution containing a hydrophilic colloid as described hereinbefore and/or a salt such as an alkali halide, using a suitable method for emulsion-coating (e.g., an extrusion coating method). Such a protective coating enhances the keeping quality of the photographic material.

The final photographic material may include two or more emulsion layers formed using the process of the present invention. In addition, the material may include one or more of a silver halide photographic emulsion layers formed according to a conventional coating method such as an extrusion coating method or a dip coating method.

The various additives described hereinbefore, hardeners and surface active agents can be properly incorporated in the emulsion layer formed in accordance with this process of the present invention, the protective layer, other emulsion layers, and/or other hydrophilic colloid layers.

The photographic emulsion layers of the present invention, the protective layer, other photographic emulsion layers and hydrophilic colloid layers which constitute the photographic material of the present invention may also contain inorganic or organic hardeners. Examples of hardeners which can be used include chrome salts such as chrome alum and chromium acetate, aldehydes such as formaldehyde, glyoxal and glutaraldehyde, N-methylol compounds such as dimethylolurea and methyloldimethylhydantoin, dioxane derivatives such as 2,3-dihydroxydioxane, active vinyl compounds such as 1,3,5-triacryloyl-hexahydro-s-triazine and 1,3-vinylsulfonyl-2-propanol, active halogen compounds such as 2,4-dichloro-6-hydroxy-s-triazine and mucohalogen acids such as mucochloric acid and mucophenoxychloric acid alone or as a combinations thereof. Of the above hardeners, active vinyl compounds and active halogen compounds are particularly preferred.

The photographic emulsion layers of the present invention, the protective layer, other photographic emulsion layers and hydrophilic colloid layers, which are the constituent layers of the sensitive materials produced in accordance with the present invention, may contain various kinds of surface active agents for a wide variety of purposes such as coating aids, the prevention of electrification, to improve slipping properties, for emulsifying and dispersing , the prevention of adhesion, and the improvement in photographic characteristics (e.g., development acceleration, high contrast, and sensitization).

Examples of surface active agents which may be employed include nonionic surface active agents such as saponin (steroid type), alkylene oxide derivatives such as polyethylene glycol, polyethylene glycol/polypropylene glycol condensates, polyethylene glycol alkyl ethers, polyethylene glycol alkyl aryl ethers, polyethylene glycol esters, polyethylene glycol sorbitane esters, polyalkylene glycol alkylamines or amides, and polyethylene oxide adducts of silicone, glycidol derivatives such as alkenylsuccinic acid polyglycerides and alkylphenol polyglycerides, fatty acid esters of polyhydric alcohols and alkyl esters of sugar. Anionic surface active agents may also be used. Examples of anionic surface active agents include those containing acid groups (e.g., carboxyl groups, sulfo groups, phospho groups, sulfate groups, and phosphate groups, etc.) such as alkylcarboxylates, alkylsulfonates, alkylbenzenesulfonates, alkylnaphthalenesulfonates, alkylsulfates, alkylphosphates, N-acyl-N-alkyltauric acids, sulfosuccinates, sulfoalkylpolyoxyethylene alkyl phenyl ether and polyoxyethylene alkylphosphates. Amphoteric and cationic surface active agents may also be used. Examples of amphoteric surface active agents include amino acids, aminoalkylsulfonates, aminoalkylsulfates, aminoalkylphosphates, alkylbetaines and amine oxides. Examples of cationic surface active agents include alkylamines, aliphatic or aromatic quaternary ammonium salts, heterocyclic quaternary ammonium salts such as pyridinium and imidazolium, and phosphonium or sulfonium salts containing an aliphatic or a hetero ring.

In particular, the fluorine-contained surface active agents described in Japanese Patent Application (OPI) No. 80849/85 and nonionic surface active agents of polyoxyethylene type are preferred.

Other additives which may be included in the photographic material of the present invention other methods which can be employed in the present invention for making, coating and drying the emulsions, and for developing the photosensitive material include those conventionally used such as those described in *Research Disclosure,* Vol. 176, pages 22 to 31 (Dec. 1978).

The silver halide photographic material produced in accordance with the present invention may be employed in all those photosensitive materials which ordinary silver halide photographic materials are used. For example, the silver halide material produced in accordance with the present invention may be used in X-ray films, black-and-white negative films, instant color photographic materials and color negative photosensitive materials.

In the interest of brevity and conciseness, the contents of the aforementioned numerous patents and articles are hereby incorporated by reference.

The present invention is illustrated in greater detail by reference to the following examples. However, the invention should not be construed as being limited to the following descriptions.

EXAMPLE 1

Production of Photosensitive Material

An emulsion was prepared using a pAg-controlled double jet preparation apparatus which was designed to control pAg of the reaction system to a prescribed value during the grain formation. The apparatus was set to −40 mV (based on a saturated calomel electrode) and 75° C., and 60 g of gelatin, a silver nitrate solution (having a silver content of 64 g) and a potassium bromide solution were added. An emulsion containing silver bromide grains which had a mean grain size of 0.8 micron (variation coefficient: 15%) and an octahedron crystal form was thereby obtained.

At the conclusion of grain formation, the emulsion was subjected to sulfur sensitization prior to degelatinizing treatment to compare the effects of various degrees of degelatinizing treatments. Then, 0.1 millmole of 1-phenyl -5-mercaptotetrazole was added to the sensitized emulsion. The resulting emulsion was labeled Emulsion (a).

Emulsion (a) was allowed to stand for a day at room temperature to allow spontaneous sedimentation of silver bromide grains. The supernatant fraction was then removed by decantation. Further, 30 liters of distilled water was added to the residue, and stirred vigorously. Then, the emulsion was allowed to stand again for a day at room temperature, and the supernatant fraction was removed by decantation. The chain of treatments was then repeated once more. Finally, the emulsion was completed by adding distilled water to produce a total amount 1 kg. The gelatin concentration in the final emulsion was determined to be 0.3 wt % (corresponding to 3 g of gelatin) by infrared spectroscopic analysis.

The emulsion was poured into a commercial trough designed for Langmuir-Blodgett method (MINI TROUGH, produced by Joyce-Loebl Co.) and allowed to stand for 2 hours at room temperature. Then, the film formed at the liquid surface was compressed until it exerted a surface pressure of 10 dyne/cm and under the constant surface pressure, the film was coated on a polyethylene terephthalate support including a subbing layer containing 0.1 g/m$^2$ of gelatin. A silver coverage of the coating was 1.9 g/m$^2$.

The gelatin was then coated on the emulsion film at a coverage of 1 g/m$^2$ to form a protective layer to obtain photosensitive material (A).

Developing Processing

Photosensitive material (A) was optically exposed for 1/10 second using 400 lux of tungsten light, through an optical wedge, and then developed at 20° C. for 10 minutes using a surface developer having the following composition:

| | |
|---|---|
| N—Methyl-p-aminophenol sulfate | 2.3 g |
| Ascorbic acid | 10.0 g |
| Potassium metaborate | 35.0 g |
| Potassium bromide | 1.0 g |
| Water to make | 1 liter |

Subsequently, the photosensitive material was subjected to stop, fixation and washing processings in accordance with conventional methods to produce an image. The image was examined for maximum density and the covering power. The results are shown in Table 1.

EXAMPLE 2

The same emulsion prepared in Example 1 (total amount: 1 kg, gelatin concentration: 0.3 wt %) was poured into a trough, having an area of 30 cm×30 cm and an outlet with a stopper (diameter: 10 cm) at a lower part of the trough side, under room temperature, and allowed to stand for 20 minutes. Then, the stopper was removed, and a portion of the emulsion in the trough was removed gradually together with the silver halide grains precipitated at the bottom of the trough. Subsequently, a polyethylene terephthalate support including a subbing layer of 0.1 g/cm$^2$ of gelatin was introduced gently into the trough in the position of the brim and another portion of the emulsion was removed until the silver halide grains suspended at the vapor-liquid interface were coated on the support. A silver coverage of the coating was 1.9 g/m$^2$. The silver halide grains were regularly arranged in the coating as shown in the Figure (magnification×15,000).

Thereafter, a protective layer was provided on the emulsion coat by applying gelatin at a coverage of 1 g/m$^2$. The resulting material was referred to as photosensitive material (B) and subjected to the same development processing as in Example 1. The results are shown in Table 1.

COMPARATIVE EXAMPLE 1

The same emulsion (a) prepared in Example 1 was processed using a so-called flocculation method. More specifically, 70 ml of a 5% aqueous solution of potassium paravinylbenzenesulfonate/acryloylmorpholine copolymer (fraction of potassium paravinylbenzenesulfonate: 70 mol%, limiting concentration in 1 N aqueous solution of sodium nitrate (30° C.): 1.380) was added to emulsion (a) at 40° C., and stirred thoroughly. Thereafter, the resulting emulsion was adjusted to a pH of 4 by adding a 10% methanol solution of salicylic acid. As the stirring is completed, the complex of gelatin and the foregoing copolymer was condensed in such a manner to embrace the silver halide, and form a sediment. The supernatant solution was removed by decantation followed by adding a 1% aqueous solution of salicylic acid to the residue, and stirring vigorously. Subsequently, sedimentation occurred at room temperature by the cessation of stirring, and the supernatant solution was removed by decantation. The above-described treatments were repeated once more, and then the emulsion sediment was redispersed by adding an appropriate amount of a 10% aqueous solution of sodium carbonate to raise the pH to 6. Gelatin was then added to produce 1 kg of final emulsion having a gelatin concentration of 10 wt % (corresponding to 100 g of gelatin).

A polyethylene terephthalate support provided with a subbing layer including 0.1 g/m$^2$ of gelatin was coated with the final emulsion prepared for coating use at a silver coverage of 1.9 g/m$^2$ using a conventional extrusion coating method. The emulsion coat was dried at 20° C.

The dried emulsion layer was then coated with a protective layer of gelatin at a coverage of 1 g/m$^2$ in the same manner as Example 1 to produce photosensitive material (C). The material was development-processed in the same manner as photosensitive material (A).

COMPARATIVE EXAMPLE 2

A photosensitive material (D) was produced in the same manner as in Comparative Example 1 except that a sivler coverage at the time of extrusion coating was 3.8 g/m$^2$. The material was development-processed in the same, manner as in the foregoing examples.

The results obtained are summarized in Table 1.

TABLE 1

| | Silver Coverage in Emulsion Layer (g/m$^2$) | Dmax | Covering Power* |
|---|---|---|---|
| Example 1 (A) | 1.9 | 3.8 | 2 |
| Example 2 (B) | 1.9 | 3.8 | 2 |
| Comparative Example 1 (C) | 1.9 | 1.9 | 1 |
| Comparative Example 2 (D) | 3.8 | 3.4 | 0.9 |

*Covering power defined as Dmax/silver coverage.

Photosensitive materials (A) and (B) achieved very high maximum density values even though they had virtually the same silver coverage as photosensitive material (C). Furthermore, their maximum densities were higher than that of the photosensitive material (D) which included twice as much silver as photosensitive materials (A) and (B). That is, the covering power was increased, while effecting an appreciable savings in the amount of silver.

Accordingly, the process of the present invention provides for the coating of solid granules in a film (as a monogranular layer) while increasing the covering of the coating material.

While the invention has been described in detail and with reference to specific embodiments thereof, it will be apparent to one skilled in the art that various changes and modifications can be made therein without departing from the spirit and scope thereof.

What is claimed is:

1. A process for forming a solid granular film comprising dispersing solid granules into a solvent in the presence of a dispersant selected from the group consisting of gelatin and surface active agents, removing the dispersant, forming a film containing the solid granules at the vapor-liquid interface between the atmosphere and the dispersion following the removal of the dispersant, and transferring the film containing the solid granules onto a support.

2. A process according to claim 1, wherein said solid granules are at least one of inorganic and organic pigments.

3. A process according to claim 1, wherein said solid granules are silver halide grains.

4. A process according to claim 1, wherein said dispersant is a surface active agent which is selected from at least one of polymeric and oligomeric surface active agents.

5. A process according to claim 1, wherein said dispersant is a gelatin.

6. A process according to claim 1, wherein said solvent is selected from at least one of water, methanol and acetone.

7. A process according to claim 1, wherein said film is formed by allowing the dispersion to stand for at least about one minute following removal of the dispersant.

8. A process according to claim 7, wherein said dispersion is allowed to stand for about three minutes to about twelve hours.

9. A process for forming a solid granular film of photographic material comprising, dispersing solid silver halide granules into a solvent in the presence of a hydrophilic colloid dispersant, removing the dispersant, forming a film containing the silver halide granules at the vapor-liquid interface between the atmosphere and the dispersion following the removal of the dispersant, and transferring the film containing the silver halide granules onto a photographic support.

10. A process according to claim 9, wherein said hydrophilic colloid is selected from at least one of gelatin, polyvinyl alcohol and carboxymethyl cellulose.

11. A process according to claim 9, wherein said solvent is selected from at least one of water, methanol and acetone.

12. A process according to claim 9, wherein said photographic support is selected from the group consisting of polyethylene terephthalate and cellulose triacetate supports.

13. A process according to claim 9, wherein said film is formed by allowing the dispersion to stand for at least about one minute following removal of dispersant.

14. A process according to claim 13, wherein said dispersion is allowed to stand for about three minutes to about twelve hours.

* * * * *